US008776945B2

(12) United States Patent
Zimmerman

(10) Patent No.: US 8,776,945 B2
(45) Date of Patent: Jul. 15, 2014

(54) NOISE BARRIER

(71) Applicant: Donald Robert Zimmerman, Mishawaka, IN (US)

(72) Inventor: Donald Robert Zimmerman, Mishawaka, IN (US)

( * ) Notice: Subject to any disclaimer, the term of this patent is extended or adjusted under 35 U.S.C. 154(b) by 0 days.

(21) Appl. No.: 13/632,432

(22) Filed: Oct. 1, 2012

(65) Prior Publication Data

US 2013/0081901 A1 Apr. 4, 2013

Related U.S. Application Data

(60) Provisional application No. 61/541,293, filed on Sep. 30, 2011.

(51) Int. Cl.
*G10K 11/165* (2006.01)

(52) U.S. Cl.
USPC ..... 181/210

(58) Field of Classification Search
USPC ..... 181/210, 211, 286, 294; 404/6
See application file for complete search history.

(56) References Cited

U.S. PATENT DOCUMENTS

| | | | | | |
|---|---|---|---|---|---|
| 4,325,457 | A * | 4/1982 | Docherty et al. | ..... | 181/210 |
| 4,773,629 | A * | 9/1988 | Yodock | ..... | 256/13.1 |
| 5,022,781 | A * | 6/1991 | Smith | ..... | 404/6 |
| 5,190,394 | A * | 3/1993 | Mallon et al. | ..... | 404/6 |
| 5,272,284 | A * | 12/1993 | Schmanski | ..... | 181/210 |
| 5,619,829 | A * | 4/1997 | Tan et al. | ..... | 52/293.3 |
| 5,938,370 | A * | 8/1999 | Gzybowski | ..... | 404/6 |
| 6,016,887 | A * | 1/2000 | Underhill et al. | ..... | 181/210 |
| 7,537,411 | B2 * | 5/2009 | Yodock et al. | ..... | 404/6 |
| 7,637,062 | B2 * | 12/2009 | Rerup | ..... | 52/144 |
| 7,789,193 | B2 * | 9/2010 | Suzuki | ..... | 181/210 |
| 2003/0019170 | A1 * | 1/2003 | Donnelly | ..... | 52/144 |

* cited by examiner

*Primary Examiner* — Jeremy Luks
(74) *Attorney, Agent, or Firm* — Faegre Baker Daniels, LLP

(57) ABSTRACT

In one embodiment of the invention, a noise barrier is disclosed that provides noise insulation from roadway noise, construction sites, manufacturing sites, railways or the like wherein the noise barrier includes a plurality of vertical sections, with each section having a base portion with a generally inverted T configuration. The inverted T configuration includes bottom flanges designed to be mounted substantially in the ground. At least one mounting post is attached to the base portion; and a barrier member manufactured from recycled rubber materials and a binder is mounted to the mounting post. The barrier member includes a through hole for receipt of the mounting post. The through hole extends from a bottom end of the barrier member vertically up and out a top end of the barrier member.

22 Claims, 6 Drawing Sheets

NOISE BARRIER

This application claims the benefit of U.S. Provisional Patent Application Ser. No. 61/541,293 filed Sep. 30, 2011, the complete disclosure of which is hereby expressly incorporated by reference.

BACKGROUND OF THE INVENTION

This invention relates to a noise barrier, primarily for use along roadways to insulate residents from roadway noise, but the barriers may also be used to shield against other noise producers such as construction sites, manufacturing sites, and railways. In particular, in one embodiment of the invention, a noise barrier is provided that is manufactured from recycled rubber materials mounted on a concrete base.

It is well known to provide noise barriers along roadways and other noise producing sites to insulate residents from the noise and commotion associated therewith. Concrete panels are the most common such noise barriers and are typically supported with steel I-beams driven into the ground. It has also been known to use wood panels and wood beams, which may be supported with steel I-beams driven into the ground. Other types of noise barriers include earth berms made from piled dirt, sod, sand or gravel to create a longer path for sound energy to travel from the noise emitter to residents in proximity thereof.

It has also been known to use rubber coatings on one of the prior types of barrier. In particular, concrete, wood, steel, etc., has been coated with a thin sheet of rubber to try to enhance noise reduction and/or reduce maintenance. It has been known to also employ noise barriers including a concrete mixed with rubber or other particles. However, applicant has developed a barrier manufactured from almost entirely recycled rubber. In one embodiment, the panels are 96 percent compressed recycled rubber with the remainder being a binder material.

SUMMARY OF THE INVENTION

In one embodiment of the invention, a noise barrier is disclosed that provides noise insulation from roadway noise, construction sites, manufacturing sites, railways or the like wherein the noise barrier includes a plurality of vertical sections, with each section having a base portion with a generally inverted T configuration. The inverted T configuration includes bottom flanges designed to be mounted substantially in the ground. At least one mounting post is attached to the base portion; and a barrier member manufactured from recycled rubber materials and a binder is mounted to the mounting post. The barrier member includes a through hole for receipt of the mounting post. The through hole extends from a bottom end of the barrier member vertically up and out a top end of the barrier member.

Each vertical section may include two mounting posts, and the barrier member includes two through holes for receipt of the mounting posts. The barrier member may include a notch around the bottom end of the through hole. The notch can be configured to allow observation of the attachment between the mounting post and base portion.

The barrier member may have an interlocking configuration on side edges of each vertical section to interlock with adjacent vertical sections. The interlocking configuration permits the angle between adjacent vertical sections to be set at a desired position. It may also include a concave profile along one vertical side edge of the barrier member and a convex profile along an opposite vertical side edge.

A part of the side edges of the base portion may have the same configuration as the barrier member. The part of the base portion with side edges having the locking configuration is wider than a lower part of the base portion adjacent the bottom flanges.

The barrier members may include approximately 96 percent recycled rubber and 4 percent binder material. The base portion may include reinforced concrete.

In one embodiment of the invention, the mounting post may include a base flange and fasteners which are used to attach the flange to the reinforced concrete base portion.

The noise barrier may include a plurality of barrier members mounted vertically on top of one another on the mounting post. The bottom barrier member may include a notch to allow observation of attachment between the mounting post and base portion. The noise barrier may also include a cap, wherein the cap is attached to the mounting post with fasteners to maintain the barrier members on the post.

In another embodiment of the invention, a noise barrier section is disclosed that provides noise insulation from roadway noise, construction sites, manufacturing sites, railways or the like that includes a base portion configured to be mounted substantially in the ground; at least one mounting post attached to an upper end of the base portion; and a barrier member including compressed rubber particles and a binder material and further including a locking configuration on side edges of the barrier member to align and orient the noise barrier section relative to adjacent noise barrier sections.

The base portion may have a generally inverted T configuration with flanges extending from a vertical member. A through hole may extend from a bottom face to a top face of the barrier member for receipt of the mounting post. The barrier member may include a notch around the bottom end of the through hole.

The interlocking configuration may include a concave profile along one vertical side edge of the barrier member and a convex vertical profile along an opposite side edge. A part of the side edges of the base portion may have the same configuration as the barrier member.

The noise barrier section may also include a plurality of barrier members vertically stacked on top of one another, each barrier member including two through holes and two mounting posts attached to each base portion. The noise barrier section may further include caps attached to the mounting posts with fasteners to maintain the barrier members thereon.

BRIEF DESCRIPTION OF THE DRAWINGS

The above-mentioned and other features and objects of this invention and the manner of obtaining them will become more apparent and the invention itself will be better understood by reference to the following description of embodiments of the present invention taken in conjunction with the accompanying drawings, wherein.

Figure 1:
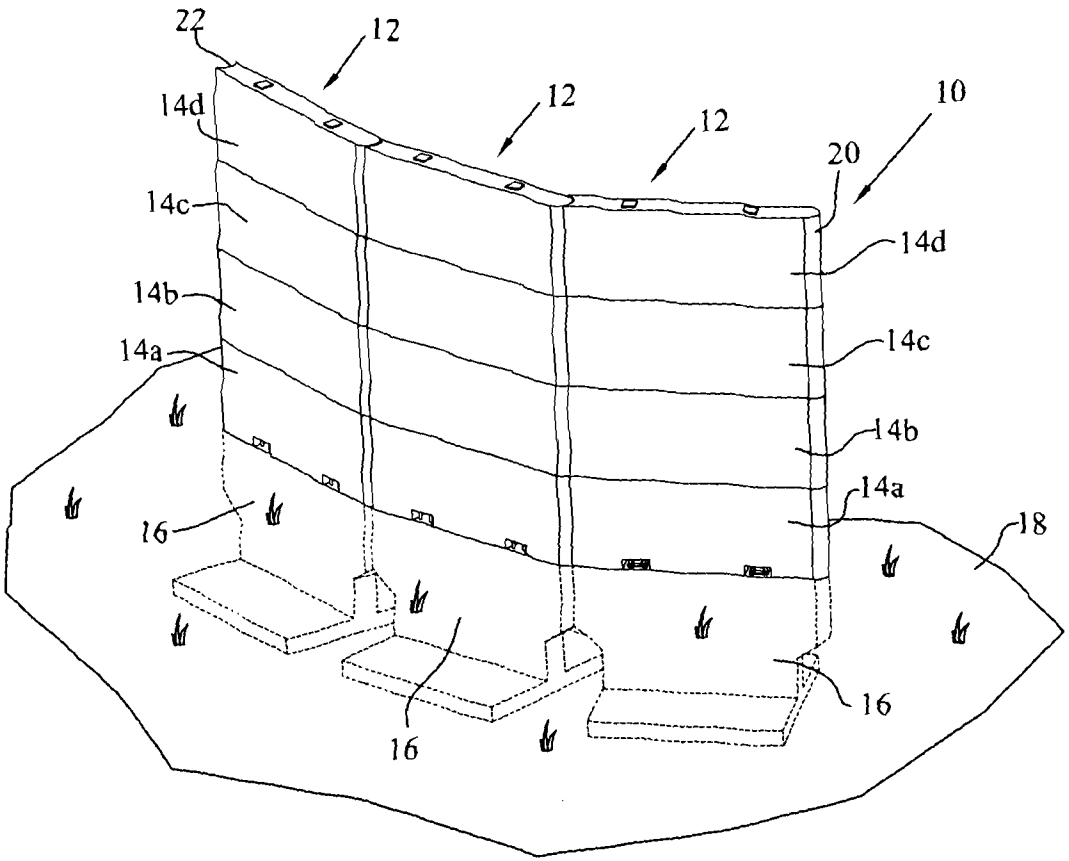
FIG. 1 is a perspective view of one embodiment of a noise barrier of the subject invention installed in a field application.
Figure 3:
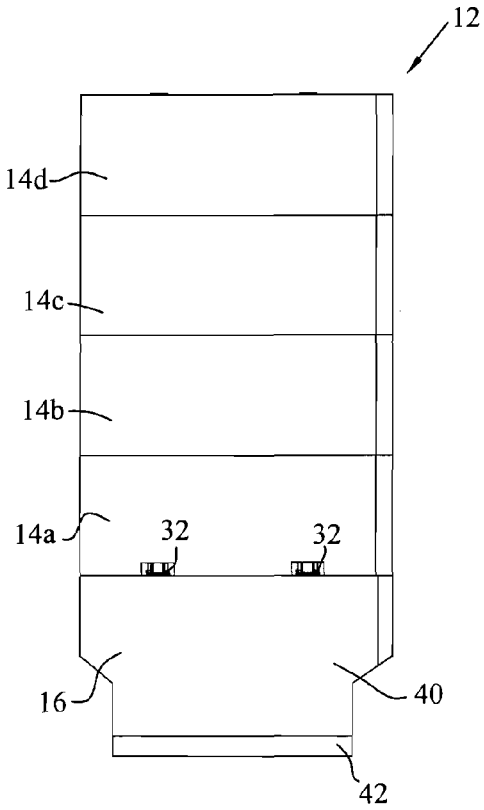
FIG. 3 is a front view of the noise barrier section of FIG. 2.
Figure 2:
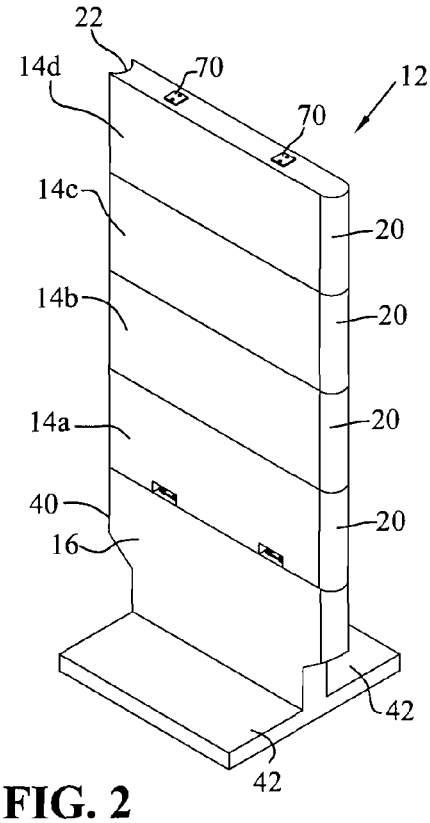
FIG. 2 is a perspective view of one isolated vertical section of the noise barrier of FIG. 1.
Figure 4:
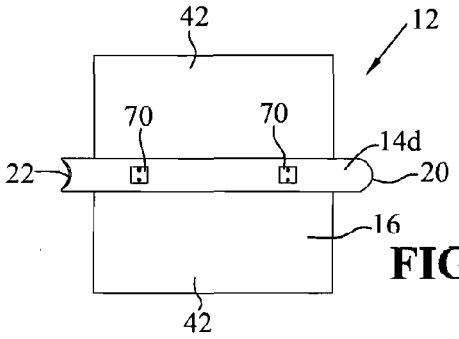
FIG. 4 is a top plan view of the noise barrier section of FIG. 2.

Corresponding reference characters indicate corresponding parts throughout the several views. Although the drawings represent embodiments of the present invention, the drawings are not necessarily to scale and certain features may be exaggerated in order to better illustrate and explain the present invention. The exemplification set out herein illustrates embodiments of the invention, and such exemplifications are not to be construed as limiting the scope of the invention in any manner.

DETAILED DESCRIPTION OF EMBODIMENTS OF THE INVENTION

For the purposes of promoting an understanding of the principles of the invention, reference will now be made to the embodiments illustrated in the drawings, which are described below. It will nevertheless be understood that no limitation of the scope of the invention is thereby intended. The invention includes any alterations and further modifications in the illustrated devices and described methods and further applications of the principles of the invention, which would normally occur to one skilled in the art to which the invention relates.

Now referring to FIG. 1, a noise barrier is shown, generally indicated as 10. This embodiment of the noise barrier includes a number of vertical sections, generally indicated as 12. Each vertical section 12 includes a plurality of individual barrier members 14*a-d* that are stacked vertically upon a base member or portion 16. Typically, base portions 16 are mounted substantially under the ground 18 so that the barrier members 14*a-d* protrude upwardly therefrom.

Now referring to FIGS. 2-9, an individual vertical section 12 is shown apart from the noise barrier 10 as a whole. Each of the noise barrier members 14*a-d* has a generally rectangular configuration and can be manufactured from compressed particles of recycled rubber held together with a binder material. In one embodiment, the barrier members consist of approximately 96 percent recycled rubber material and 4 percent binder. It should be appreciated that other rubber to binder ratios may be utilized and furthermore, that the term rubber as used herein can include any number of compounds generally having a rubber base, as well as other natural or synthetic substitutes therefor.

The back and front of barrier members 14*a-d* are generally flat as are the top and bottom ends thereof. At the sides, however, barrier members 14*a-d* include an interlocking configuration along side edges thereof. In the embodiment shown, each barrier member includes a convex profile 20 extending along one side edge and a concave profile 22 extending along the opposite side edge (see FIG. 4). As is shown in FIG. 1, and discussed in further detail below, convex side edges 20 are configured to be received in the concave side edge 22 of an adjacent vertical section 12. This allows each vertical section 12 to be set at a desired angle relative to one another to follow the contour of the roadway along which it is placed, while also maintaining the vertical sections in an overlapping relationship to prevent gaps therebetween.

Figures 5, 5A:
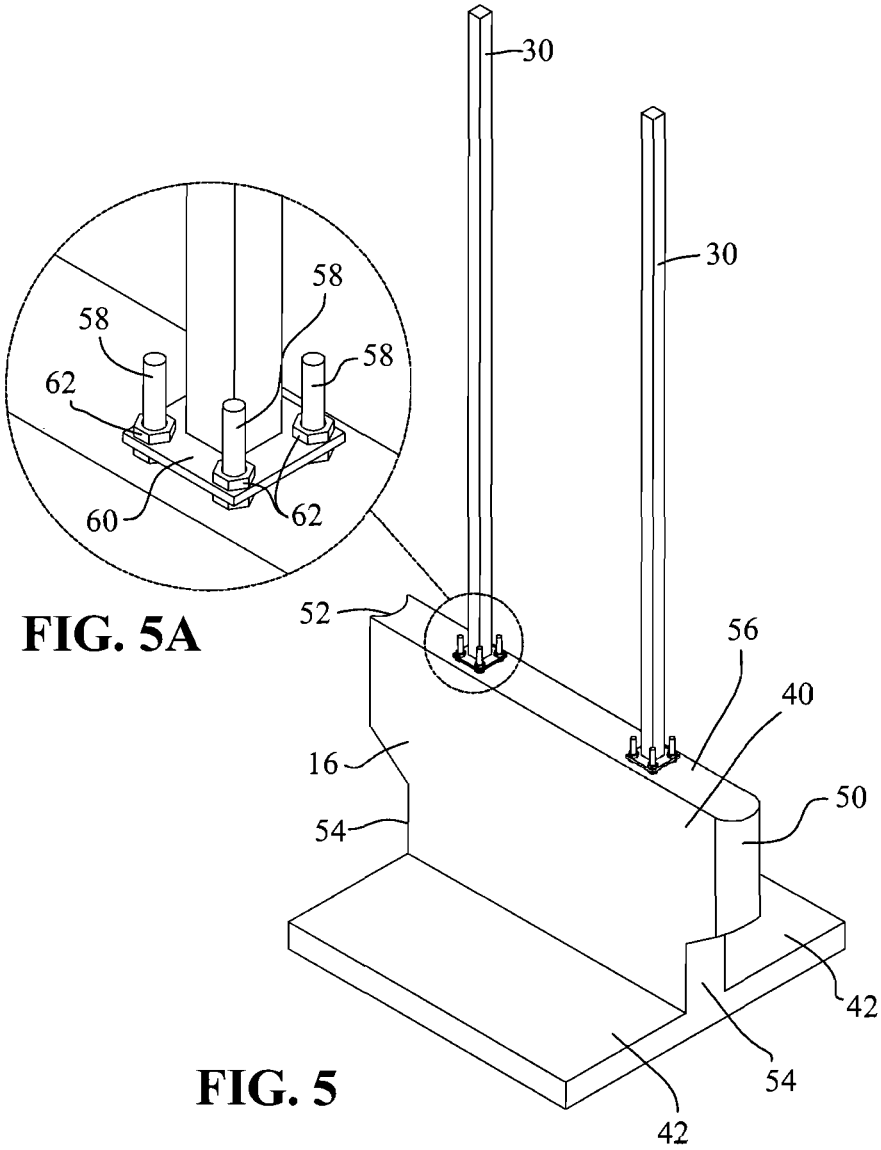
FIG. 5 is a perspective view of a base portion of the noise barrier section of FIG. 2 with mounting posts attached thereto.
FIG. 5A is an enlarged view of the area indicated in FIG. 5 showing details of the attachment of the mounting posts.
Figure 6:
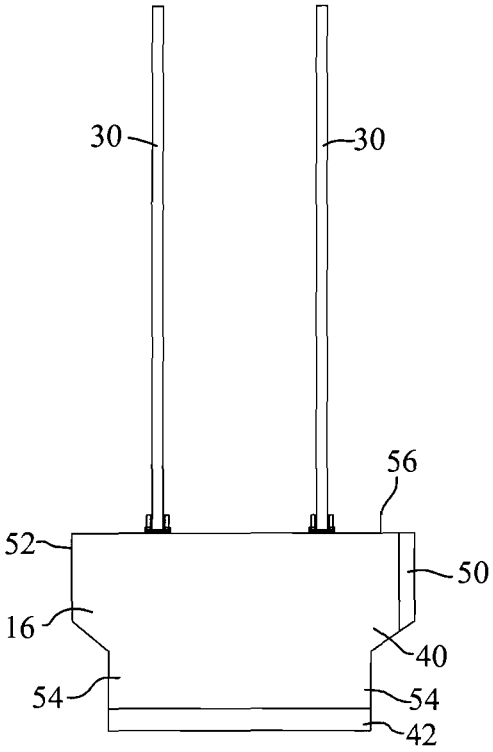
FIG. 6 is a front view of the base portion and mounting posts of FIG. 5.
Figure 7:
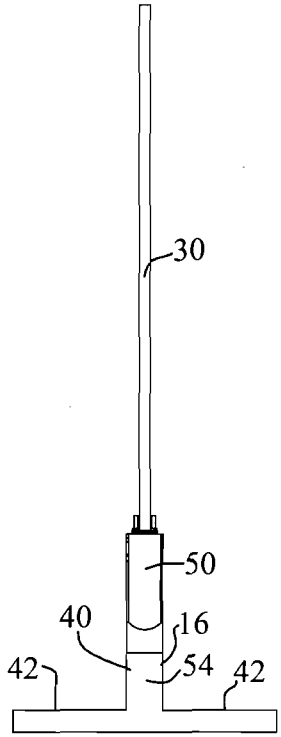
FIG. 7 is a side view of the base portion and mounting posts of FIG. 5.
Figure 8:
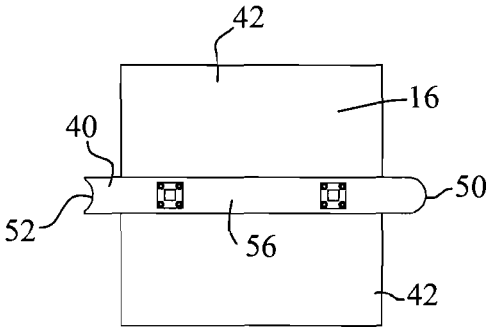
FIG. 8 is a top plan view of the base portion and mounting posts of FIG. 5.

Each barrier member 14*a-d* also includes a pair of through holes 24 for receipt of mounting posts 30, which are attached to base section 16 as best shown in FIG. 5. The through holes extend from the bottom end or face of each barrier member vertically up through to the upper face or end. In this embodiment, through holes 24 have a generally square or rectangular configuration to mate with the configuration of mounting posts 30; however, the configuration of both the mounting posts and the holes may be varied.

Figure 9:
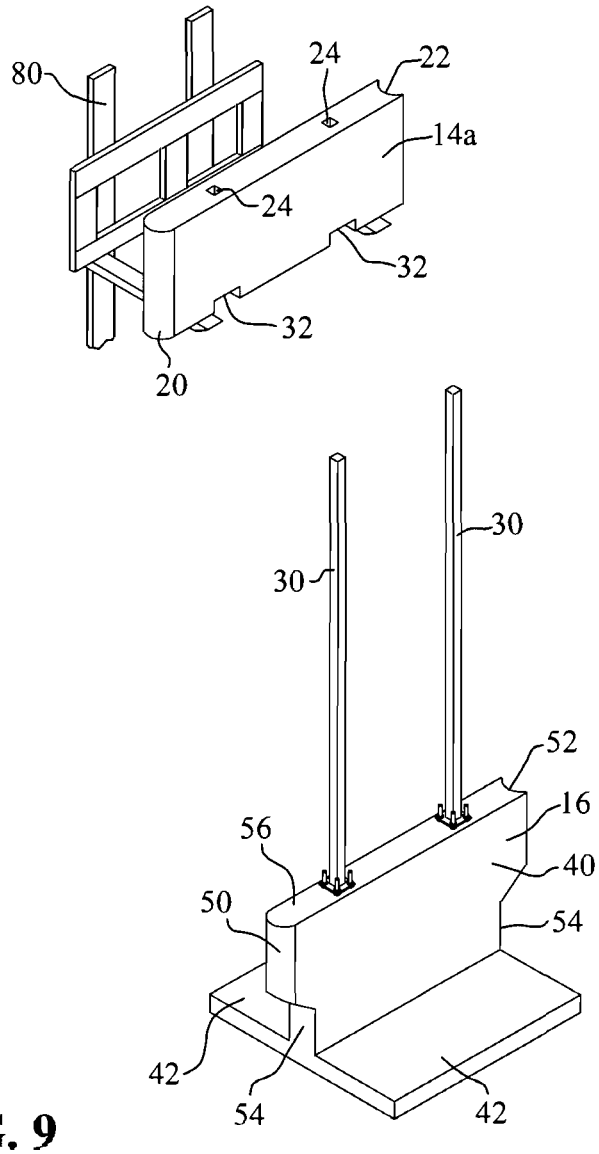
FIG. 9 is a perspective view of a barrier member to be mounted onto the base portion and mounting posts of FIG. 5.
Figure 10:
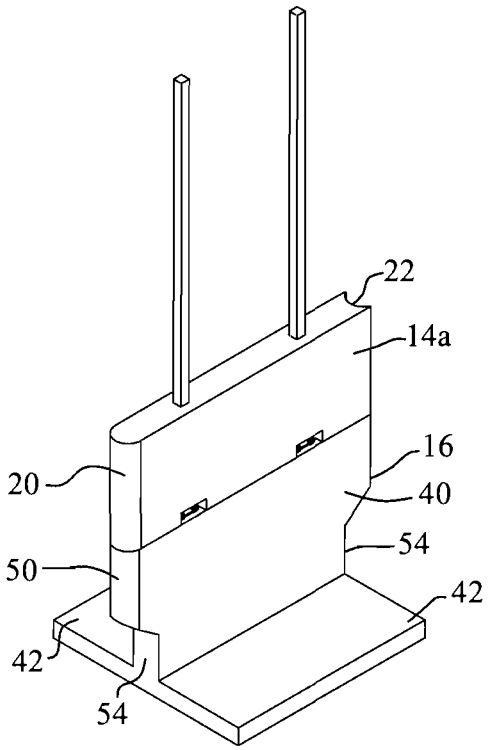
FIG. 10 is a perspective view of the barrier member of FIG. 10 mounted to the base portion and mounting posts.
Figure 11:
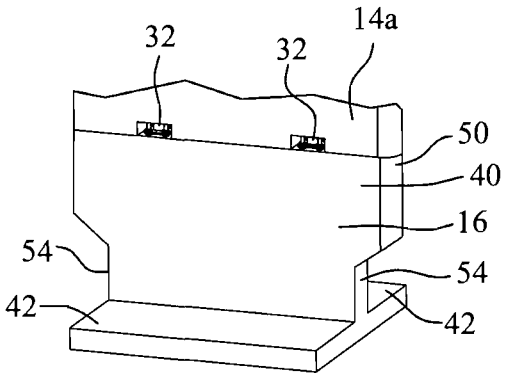
FIG. 11 is a perspective view showing notched areas in the barrier member for examination of the attachment areas of the mounting posts to the base portion.

Also as shown in FIG. 9, barrier member 14*a*, and only barrier member 14*a*, includes notches 32 at the bottom end thereof. The notches intersect with through holes 24 to allow observation of the attachment from mounting posts 30 to base portion 16 as discussed in further detail below.

Regarding base portion 16, in the embodiment shown, each base member has a generally inverted T configuration to provide stability when buried in the ground. The T configuration includes a vertical portion or member 40 and a pair of legs or flanges 42 extending outwardly therefrom. Of course, it should be appreciated that other configurations may be utilized for the base portion, such as that of an I-beam or any suitable configuration that will provide the needed support for the barrier members when buried in the ground or otherwise anchored.

The base portion may be manufactured from concrete, reinforced concrete or other known materials, such as metals or synthetic materials that provide the required strength and rigidity.

Vertical member 40 includes side edges or ends of which a portion has an interlocking configuration to match that of the barrier members. In particular, the upper portions of the side ends of vertical member 40 includes a convex profile 50 on one end and a concave profile 52 on an opposite end. In addition, the portion of vertical member 40 with the interlocking configuration extends out wider than a narrower lower portion 52 which intersects with flanges 42. Lower portion 52 of base member 16 has the same width as flanges 42. Furthermore, vertical member 40 of base portion 16 includes an upper face or end 56 to which mounting posts 30 are attached. Lag bolts or fasteners 58 may be mounted in upper end 56 of vertical portion 40 to provide the attachment of the mounting posts 30 to base member 16, as best shown in FIG. 5A. Lag bolts 58 are mounted to upper end 56 using techniques known to those skilled in the art.

In the embodiment shown, mounting posts 30 have a generally square or rectangular cross section. A flange 60 is attached to a lower end of each mounting post, as best shown in FIG. 5. The flanges 60 include holes configured to receive lag bolts 58. The mounting posts are secured to the lag bolts using nuts 62. Standard or locking washers (not shown) as is known in the art may be used when securing nuts 62 to lag bolts 58.

Now referring again to FIGS. 2 and 4, caps or top plates 70 may be attached to the mounting posts 30 to secure barrier members 14*a-d* thereto. Fasteners may be used to secure a cap 70 to holes drilled in the top of mounting posts 30.

To utilize vertical sections 12 and noise barrier 10, a trench is dug in the desired location and base members 16 are set in place adjacent one another with interlocking side edges 50, 52 engaged with the adjacent member at the desired orientation relative to one another. The trench is then filled in to secure base members 16 in the ground with only a small portion of vertical member 40 located above ground. It should be appreciated that concrete fill or other enhanced anchoring may be utilized if needed. Mounting posts 30 are then attached to the respective upper end 56 of base members 16 using lag bolts 58 and nuts 62. Barrier members 14*a-d* are then slid over mounting posts 30 so that the mounting posts extend through through holes 24. A forklift 80 or other crane or lifting device may be used to place barrier members on the mounting posts (see FIG. 9).

As stated previously, the lower most barrier member 14*a* includes notches 32 so that the attachment of mounting posts 30 to base member 16 (i.e., lag bolts 58 and nuts 62 secured to flange 60 of mounting posts 30) is visible for inspection. The remaining barrier members are then set in place with the mounting posts 30 extending through through holes 24 until the desired height is reached. Only bottom post 14*a* needs to include notches 32; however, the upper barrier members 14*b-d* may also include notches if it is desired to only use one uniform mounting barrier member configuration.

As the barrier members are applied on adjacent vertical sections, interlocking sides 20, 22 are engaged and matched in orientation with interlocking configuration 50, 52 on the base members. Base members are secured with caps 70 attached to mounting posts 30 using fasteners. The end result is an effective, aesthetic, and easily repairable noise barrier.

Over the course of time, if it is desired to increase or lower the height of the noise barrier, or if the attachment or any barrier members need replacement, the present design lends itself to readily doing so. The fasteners holding caps 70 are simply removed to allow the caps to be taken off, barrier members can be slid upwards and off of mounting posts 30, and attachment of the mounting posts removed, repaired, or replaced if necessary.

While the invention has been taught with specific reference to these embodiments, one skilled in the art will recognize that changes can be made in form and detail without departing from the spirit and scope of the invention. For example, although the embodiment shown includes four barrier members on each base, more or less barrier members may be employed to achieve the desired height. The length of the mounting posts is likewise changed to match the desired height. It should also be appreciated that the weight of the base may be increased for increased heights of the noise barrier to provide sufficient stability.

It should further be realized that the subject noise barrier invention may be provided in any color desired or with a decorative mural on the barrier members.

In addition, the embodiment shown in the figures includes two mounting posts and two holes; however, the number, configuration, and cross section of the mounting posts and through holes may be varied. For example, a single wider mounting hole and post may be used or additional mounting holes and posts may be provided. It should also be appreciated that the barrier members may be mounted to the posts using fasteners instead of extending internally through the holes, or the barrier members may be sandwiched between two mounting posts or members.

Also, other configurations for the locking side edges in the base members and barrier members may be utilized. The described embodiments are to be considered, therefore, in all respects only as illustrative and not restrictive. As such, the scope of the invention is indicated by the following claims rather than by the description.

The invention claimed is:

1. A noise barrier to provide noise insulation from roadway noise, construction sites, manufacturing sites, railways or the like wherein the noise barrier includes a plurality of vertical sections, each section comprising:

a base portion having a generally inverted T configuration with bottom flanges and configured to be mounted substantially in the ground;

at least one mounting post attached to the base portion; and a barrier member manufactured from recycled rubber materials and a binder, the barrier member being mounted to the mounting post and having an interlocking configuration on side ends of each vertical section to interlock with adjacent vertical sections, the interlocking configuration permits the angle between adjacent vertical sections to be set at a desired position, and the interlocking configuration includes a concave profile along one vertical side end of the barrier member and a convex profile along an opposite vertical side end and wherein a part of the side ends of the base portion has the same configuration as the barrier member.

2. The noise barrier as set forth in claim 1, wherein the barrier member includes a through hole for receipt of the mounting post.

3. The noise barrier as set forth in claim 2, wherein the through hole extends from a bottom end of the barrier member vertically up and out a top end of the barrier member.

4. The noise barrier as set forth in claim 3, wherein each vertical section includes two mounting posts, and the barrier member includes two through holes for receipt of said mounting posts.

5. The noise barrier as set forth in claim 3, wherein the barrier member includes a notch around the bottom end of the through hole.

6. The noise barrier as set forth in claim 5, wherein the notch is configured to allow observation of the attachment between the mounting post and base portion.

7. The noise barrier as set forth in claim 1, wherein the part of the base portion with side ends having the same configuration as the barrier member is wider than a lower part of the base portion adjacent the bottom flanges.

8. The noise barrier as set forth in claim 1, wherein the barrier members include approximately 96 percent recycled rubber and 4 percent binder material.

9. The noise barrier as set forth in claim 1, wherein the base portion includes reinforced concrete.

10. The noise barrier as set forth in claim 9, wherein the mounting post includes a base flange, and fasteners are used to attach the flange to the reinforced concrete base portion.

11. The noise barrier as set forth in claim 1, including a plurality of barrier members mounted vertically on top of one another on the mounting post.

12. The noise barrier as set forth in claim 11, wherein only the bottom barrier member includes a notch to allow observation of attachment between the mounting post and base portion.

13. The noise barrier as set forth in claim 11, further including a cap, the cap attached to the mounting post with fasteners to maintain the barrier members on the post.

14. A noise barrier section to provide noise insulation from roadway noise, construction sites, manufacturing sites, railways or the like comprising:

a base portion configured to be mounted substantially in the ground, the base portion having interlocking contours along at least a portion of vertical side edges thereof configured to interlock with adjacent base portions;

at least one mounting post attached to an upper end of the base portion; and a barrier member including compressed rubber particles and a binder material and further including a locking configuration on side edges of the barrier member to align and orient the noise barrier section relative to adjacent noise barrier sections, the locking configuration providing adjustment to vary the angle of adjacent barrier members relative to one another.

15. The noise barrier section as set forth in claim 14, wherein the base portion has a generally inverted T configuration with flanges extending from a vertical member.

16. The noise barrier section as set forth in claim 14, including a through hole extending from a bottom face to a top face of the barrier member for receipt of the mounting post.

17. The noise barrier section as set forth in claim 16, wherein the barrier member includes a notch around the bottom end of the through hole.

18. The noise barrier section as set forth in claim 14, wherein the locking configuration includes a concave profile along one vertical side edge of the barrier member and a convex vertical profile along an opposite side edge.

19. The noise barrier section as set forth in claim 18, wherein a part of the side edges of the base portion has the same configuration as the barrier member.

20. The noise barrier section as set forth in claim 16, including a plurality of barrier members vertically stacked on top of one another.

21. The noise barrier section as set forth in claim 20, wherein each barrier member includes two through holes, and two mounting posts are attached to each base portion.

22. The noise barrier section as set forth in claim 21, further including caps attached to the mounting posts with fasteners to maintain the barrier members thereon.

* * * * *